United States Patent [19]

Dötzer et al.

[11] 4,380,170

[45] Apr. 19, 1983

[54] PROCESS FOR THE CHEMICAL PLOTTING OF BOUNDARY LAYER FLOWS, AND CHEMIGRAPHY MATERIALS FOR THE PRACTICE THEREOF

[75] Inventors: Richard Dötzer, Nuremberg; Winfried Plundrich, Kalchreuth, both of Fed. Rep. of Germany

[73] Assignee: Siemens Aktiengesellschaft, Berlin and Munich, Fed. Rep. of Germany

[21] Appl. No.: 168,245

[22] Filed: Jul. 14, 1980

[30] Foreign Application Priority Data

Jul. 16, 1979 [DE] Fed. Rep. of Germany ..... 2928690

[51] Int. Cl.[3] ..... G01M 10/00

[52] U.S. Cl. ..... 73/147; 73/148; 73/168

[58] Field of Search ..... 73/147, 148, 168; 346/1.1; 430/357, 495, 526; 23/230 A

[56] References Cited

U.S. PATENT DOCUMENTS

| | | | |
|---|---|---|---|
| 3,787,874 | 7/1972 | Urban | 73/147 |
| 3,890,835 | 6/1975 | Dotzer et al. | 73/147 |
| 3,913,393 | 10/1975 | Facy | 73/147 |

FOREIGN PATENT DOCUMENTS

| | | | |
|---|---|---|---|
| 896786 | 5/1944 | France | 73/147 |

*Primary Examiner*—James J. Gill

*Attorney, Agent, or Firm*—Kenyon & Kenyon

[57] ABSTRACT

The chemical plotting of boundary layer flows in liquids with the use of uncompacted, coated, anodically oxidized aluminum surfaces is effected using a colored or uncolored liquid or a coating or pointillization with a substance, preferably a dye, soluble in water or organic media and which can be included or adsorbed in the eloxal layer.

The process serves to plot boundary layer flows in water, organic media and oils in a wide temperature range.

11 Claims, 30 Drawing Figures

PROCESS FOR THE CHEMICAL PLOTTING OF BOUNDARY LAYER FLOWS, AND CHEMIGRAPHY MATERIALS FOR THE PRACTICE THEREOF

BACKGROUND OF THE INVENTION

The invention relates to a process for the chemical plotting of boundary layer flows on anodically oxidized uncompacted aluminum surfaces.

For many areas of technology, observation of boundary layer flows is important. In particular, it is of interest to determine boundary layer flows in machine, apparatus and equipment parts as well as in cooling and heating units, along walls of ships, marine structures, liquid tanks, and the like. Flow phenomena and their determination also give information concerning the boundary layer thickness and concerning heat and material transfer. Methods used to this end, employing measuring probes, e.g. laser anemometers, by attaching a plurality of wool threads and photographing them during exposure to flow; by erosion or entrainment of soluble or viscous coatings; by chemical alteration of surface layers or surface coatings by means of suitable chemicals introduced into the flowing liquid, e.g. the schlieren method are very expensive.

It is further known to plot boundary layer flows in gases by exposing an anodically oxidized uncompacted aluminum surface to an air stream mixed with reactive acid or basic chemical reagents and coloring the layer which is differently altered by the gas stream (U.S. Pat. No. 3,890,835).

SUMMARY OF THE INVENTION

The object of the present invention is to plot boundary layer flows in flowing aqueous, non-aqueous and oil media and to make them locally visible on the surfaces exposed to flow, in order to obtain information concerning the flow phenomena, the flow over surfaces, the boundary layer thickness and the heat and material transfer for the testing and optimizing of flow processes for objects of interest in terms of fluid mechanics, such as ships and motors.

This and other objects are achieved, according to the present invention, in that there is applied, on an anodically oxidized aluminum surface which is not compacted or not completely compacted, a dye which can be included and adsorbed in the eloxal coating and containing at least one substance which cannot be included or adsorbed in the eloxal coating and which is soluble in water or organic media, said surface then being exposed to the flow of a colorless or colored liquid, and the discoloration and/or contouring inscribed by the boundary layer flow in the surface active eloxal film developed.

Suitable aluminum surfaces may consist, according to the invention, of an anodizable aluminum material, a material coatable with anodizable aluminum, or a material bonded or covered with a self-adhering anodizable aluminum foil.

The process according to the invention is easy to carry out at a relatively low cost of time and engineering, and permits direct plotting of the boundary layer flow conditions. Interpretation and evaluation is easy to effect due to the sharp contours of the plot. In particular, there is no distortion in the chemigraphic record. In addition, local visualization of intensity and direction of flow on the surfaces exposed to flow is possible. Of particular advantage is the possibility of carrying out the process not only at room temperature but also at lower temperatures (to about −20° C.) and especially at elevated temperatures up to about 250° C., and that informative boundary layer flow chemigraphs can be obtained both on smooth and on rough surfaces. Also, the shape of the model to be examined is not critical, since the eloxal film with the dye inclusion can be produced even in acute angles and on rounded parts. Due to the possibility of compacting the chemigraphed color eloxal film, the boundary layer plots have almost unlimited durability in their color intensity. Since the conditions for the production of the eloxal film thickness and of the dye concentration can be adjusted exactly, they ensure a high reproducibility of the "substrate substance concentration" even for short exposure times. The process according to the invention offers the possibility of plotting the boundary layer flows of, for example, an impeller in a flow apparatus even at extremely high speeds of rotation, since there is no chipping off or hurling away of the prepared coating due to the occurring centrifugal forces. Even low- and high-viscosity liquids still lead to chemigraphs of sharp contours.

The surfaces to be chemigraphed, i.e., surface-active eloxal surfaces, are suitable components and shaped parts of preferably colorlessly anodizable Al materials, so that impairment of the color contrasts is ruled out. Preferably, however, gluable foils and sheets of pure aluminum in thicknesses of from about 20 micron to about several millimeters are employed. For objects of interest in terms of fluid mechanics whose surfaces do not consist of colorlessly anodizable Al materials, one prepares models made of such Al materials (e.g. of Raffinal®, $AlMg_3$ or $AlMgSi_{0.5}$) or one coats their surfaces, or at least the surface areas of interest in terms of fluid mechanics, with colorlessly anodizable aluminum, Al foils or Al sheets. If objects of electrically conductive materials are involved, their surface can be coated by the galvanoaluminizing process with galvano-aluminum which anodizes excellently and in a colorless-transparent way (Sigal® surface). The galvano-aluminum-eloxal layer surfaces can be dyed very homogeneously and uniformly; they are free of textures and at 4000 $N/mm^2HV$ advantageously hard, that is, especially suitable for surfaces under heavy or even abrasive stress in terms of fluid mechanics. The galvano-aluminum-eloxal coating of components and shaped parts is useful preferably when the surfaces to be chemigraphed are curved in three dimensions (for example, the propeller blade of a ship's screw or the surface of a mixing or conveyor screw) and when the form-exact covering or bonding with Al foil presents difficulties. Other suitable methods for the coating of components or shaped parts of aluminum are, for example, vacuum vapor deposition, flame spraying and immersion aluminizing, if the aluminum coatings obtained thereby can be anodized uniformly in sufficient density and thickness and, preferably, colorlessly.

Suitable flowing media are, for example, water and aqueous and organic solutions as well as oily and pasty liquids.

By the process according to the present invention it is possible to plot boundary layer flows by means of characteristic dye adsorption, for example, on eloxal films produced by the d-c sulfuric acid process (GS process) in the thickness range of 1–25 micron, preferably 8–12 micron.

To this end, a procedure A according to the present invention provides for coloring the liquid homogeneously with a dye adsorbed by the colorless eloxal coating. At conditions of stationary liquid there occurs slow diffusion and adsorption of dye uniformly on all surface areas in contact with the colored liquid. At flowing liquid conditions, on the contrary, more dye is adsorbed with decreasing boundary layer thickness as a function of the respective boundary layer thickness and flow treatment time and a characteristic picture of the local boundary layer flow is thereby plotted directly. Because the boundary layer flow inscribes itself, as it were, even into the surface-active eloxal coating, such a plotting method may be termed "eloxal color layer chemigraphy of boundary layer flows".

Especially for non-aqueous liquids, a procedure B, the negative procedure to procedure A, has proved successful. To this end, the invention provides for coloring the eloxal surface homogeneously and adding to the flowing liquid an agent which decolorates the dye or visibly varies it chemically. With decreasing boundary layer thickness, the agent becomes effective more strongly and faster. There results in eloxal color layer chemigraphic negative.

According to another advantageous embodiment of the process of the invention (procedure C), it is possible, both if the uncompacted eloxal surface is colored and if it is not colored, to bring about by the flowing medium a compacting process which leads to a latent chemigraphic picture which becomes visible by a development process, i.e., by etch-contrasting or by coloring.

This procedure is especially suitable for hot liquids containing hydroxyl ions. Wherever the hot hydroxyl ion containing liquid flows over the colored eloxal coating, the dye is included boil-resistant by compaction of the eloxal coating microstructure. From the surface areas not contacted by the hot liquid or only moderately so, the dye can be dissolved out by subsequent treatment with dilute reagents, e.g. dilute nitric acid or sulfuric acid. Thereby a particularly high-contrast chemigraphic picture of the boundary layer flow is formed (etch contrasting).

This procedure with hot hydroxyl ion-containing liquids also is usable for eloxal-coated surfaces which have not been colored, in which case the surface areas not contacted or only moderately so then absorb dye during the subsequent coloring and thus stand out well from the compacted surface areas which can no longer take up any dye.

According to another advantageous embodiment of the process of the invention (procedure D), the local direction and, under certain conditions, also the velocity of the boundary layer flow and the progressive development thereof in time can be recorded. On the surfaces of surface-active eloxal coatings, the adsorbable dye is deposited in the form of dye dots, preferably regularly with the aid of the screen printing technique in any desired density or loosened up directly on the eloxal coating surface into the boundary layer(s) as it were. The dye may be selected such that it is or is not dissolved by the flowing liquid. In the latter case, the dissolution of the dye is brought about by a solubilizing addition to the flowing liquid. In either case the small punctiform dye deposits are dissolved in proportion to the local boundary layer flow with the surprising result that dye is adsorbed into the surface-active eloxal coating, clearly visible, directly from this small volume of color solution, which is entrained by the boundary layer flow such that there emanates a color streamer, which immediately "inscribes" itself chemigraphically into the eloxal coating and thereby plots and visualizes the local course of the boundary layer flow. The chemisorptive bond of the dye molecules in the eloxal coating microstructure, e.g. cups, tubes, is so strong that the color streamers are not washed out by the liquid which continues to flow over them and the pointillized boundary layer flow chemigraph is stable and durable. At exposure times of a few minutes down to the seconds range, boundary layer flow patterns can be plotted and fixed true to direction.

With this procedure, referred to as "pointillization technique", there is a relationship between color streamer length and local velocity of the boundary layer flow. However, a simple relationship seems to exist only for laminar flow and within certain velocity ranges.

If observation of the change in flow or respectively a different flow pattern setting in at a later time by plotting the boundary layer flow pattern is desired, the procedure (procedure E) referred to in the following as "double pointillization" has proved particularly successful. It also makes possible the elimination or suppression of start-up influences on the boundary layer flow chemigraphy of stationary liquid flows. According to the invention, a dye dot raster (screen) applied on the eloxal surface by the pointillization method is printed through a colorless, non-chemigraphing substance which dissolves slowly (or at first not at all), which can be applied over the entire surface in sufficient layer thickness, printing it thereon with a second screen of the same dot sequence but with a somewhat larger dot diameter. With eloxal surfaces thus prepared, the chemigraphing of the boundary layer flow begins only after the dissolving of the overprinted substance, that is, start-up or immersing problems can be eliminated. For substances which are not soluble, the dissolution is brought about at the desired moment by the addition of small quantities of a dissolving material into the liquid volume. Since this dissolving process takes place in the proportion of the local boundary layer flow, there is no disturbing influence on the boundary layer flow chemigraphy.

This foregoing procedure and still another procedure utilize the principle of screen printing which is known in itself. This further embodiment of the process of the invention (procedure F) is used to particular advantage for substances which are rather unstable in moist air. To this end, the invention provides printing on a homogeneously colored eloxal surface, preferably by a screen printing technique, substance dots of, for example, reducing substances, such as sodium dithionite $Na_2S_2O_4$ or hydrazin sulfate $N_2H_6SO_4$, or oxidizing substances, such as ammonium persulfate $(NH_4)_2S_2O_8$, sodium persulfate $K_2S_2O_8$, sodium perborate $NaBO_2.H_2O.3H_2O$ or $Na_2B_4O_7.H_2O_2.9H_2O$, perborax, or decomposing substances, which are then dissolved by the flowing liquid and, according to the pattern of the boundary layer flow, decolorate or visibly alter the adsorbed dye.

For the coloring of the eloxal coating or respectively of the liquid medium, suitable dyes for the process of the invention are water-soluble dyes, dyes soluble in organic solvents and oil-soluble dyes, in particular the commercially available aluminum dyes, e.g. alizarine, indanthrene, anthraquinone, axo, indigo, or quinaldine dyes.

For the application of the "pointillization technique" the same dyes are used for aqueous flow media.

In the case of non-aqueous media, commercially available color pastes (Aluprint®) or commercial dyes (e.g. Savinyl®), are preferably employed.

For oily media, the above mentioned Aluprint® pastes or the dyes Sudan Blue®, Red, etc. are especially suitable.

However, for use in screen printing, these dyes, some of which are in powder from, must be brought to a pasty state.

Often a multi-component paste has proven particularly favorable, in which one component has the function of the actual printing paste of suitable consistency and surface tension as well as giving excellent bonding strength to the dye deposit, preferably to the screen-printed dye deposit, while the other component represents the actual chemigraphic dye, which is dissolved by flowing liquid media and is chemisorbed and adsorbed from the colored boundary layer flow volume into the surface-active eloxal film. To adjust the required viscosity, a diluent, preferably methyl ethyl ketone, is further added.

When using, for example, non-aqueous or oily flow media, for which the chemigraphic dye is not directly soluble, small quantities of an organic but miscible solvent, for example, acetone, dichloromethane, toluene or xylene, are added to the flow medium.

To intensify the chemigraphic plotting effect, there may be added to the dye and reagent pastes substances which fluoresce or light up in UV light. In special cases, radio-actively labelled substances can be used, which will, after chemigraphing, by placing a radiation-sensitive foil on the chemigraphed eloxal film in a known manner, make visible very sensitively by prolonged exposure times even very dilute substances absorbed in minute quantity, thus visualizing the course of the boundary layer flow. Also appropriate combinations of photographically usable substances have proved advantageous.

For the procedure according to the invention by pointillizing by means of screen printing using a raster, for example, a raster with dot, line or circle raster openings, two raster units being used in double pointillization whose openings, for example, dot or line openings, are somewhat larger in the second raster than in the first (FIGS. 4 and 5), one uses covering and protective pastes which dissolve sufficiently slowly in the liquid medium, do not react with the dye and cannot be adsorbed or included in the surface-active eloxal film. If the paste contains components insoluble in the liquid medium, they must be dissolvable by addition of minute quantities of solubilizers. Printing pastes of can sugar (sucrose), methyl cellulose and water, or gelatin, methyl cellulose and water have proved suitable. Especially suitable paste mixtures consist of 50 parts by weight sucrose, 4 parts by weight methyl cellulose and 46 parts by weight water, or 2–3 parts by weight gelatin, 0.5 parts by weight methyl cellulose and about 60 parts by weight water.

After the printed eloxal film-aluminum foils or aluminum sheets have been dried in clean air at room temperature in about 2 hours or in a drying oven at 50° C. in about 30 minutes, the chemigraphy materials according to the invention are usable for boundary layer flow plots. Packed or sealed in polyethylene foil bags, they are stable at room temperature in a dry atmosphere for at least one year and store well.

The process according to the invention is used to particular advantage for the plotting of boundary layer flows which occur in cooling and heating units as well as in circulating, electroplating and rinsing baths. The plots permit, e.g. the optimization of the water cooling of flat assemblies.

DETAILED DESCRIPTION OF THE INVENTION

Figure 1A:
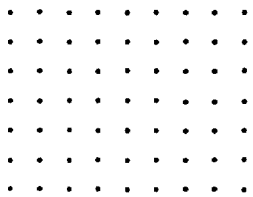
FIGS. 1A, 1B, 2A, 2B, 3A and 3B illustrate several discontinuous patterns of materials, consisting of or containing dye dissolvable in liquid and includable in the aluminum layer, which can be applied to the aluminum layer.

The invention will be explained in greater detail by reference to the following examples.

PREPARATION OF THE CHEMIGRAPHY MATERIAL

(a) Preparation of a colorless aluminum-eloxal coating surface

1. A cylinder (or hollow cylinder) 55 mm high by 60 mm diameter made of $AlMg_3$, whose surfaces are to be examined chemigraphically in the water tunnel, is degreased in a stabilized perchloroethylene vapor bath, etched for a few seconds in NaOH, and its surface cleaned in rinsing and pickling baths, e.g. of dilute $HNO_3$.

Immediately thereafter, the cleaned cylinder (or hollow cylinder) is fixed and contacted in an anode frame of titanium material and its surface anodically oxidized at a current density of 1.5 $A/dm^2$ and at a bath voltage increasing from 0 to 17 V in a d-c sulfuric acid eloxizing bath (GS batch) at 18° C. for about 30 minutes.

2. The three-dimensionally curved surface of a model ship's screw of steel, brass or bronze is coated with a galvanoaluminum coating of about 20 micron, and the very homogeneous silver-bright galvano-aluminum coating is then anodized in the GS or GSX bath in a thickness of about 15 micron.

3. On developable component surfaces, self-adhering aluminum foil pieces about 0.1 mm thick are applied, which had previously been cleaned by brief immersion in dilute soda lye, water, and de-ionized water. For anodizing, the parts are then immersed in a GSX bath and anodically oxidized for 40 minutes at 1.5 A/dm$^2$ current density, 22 Volt bath voltage and 13° C.

(b) Coloration of an aluminum eloxal film

1. A sample prepared according to method (a1) was colored at a bath temperature of 20° C. for 5 minutes in a coloring bath containing 3 g/l "Aluminum Blue®". After rinsing in water of 20° C. for about 0.5 minutes, the cylinder surfaces show a blue coloration homogeneous on all sides and can be used immediately for chemigraphy tests after drying at 50° C. or immersion-rinsing in acetone and blowing dry with oil-free compressed air. Sealed in polyethylene foils and kept at room temperature, the colored eloxal surfaces are surface-active and ready for use practically for 12 months.

2. A workpiece coated on one side with an eloxal film of about 15 micron according to method (a3) and bonded with aluminum foil is homogeneously colored deep red using a coloring bath as follows:

Coloring bath: 3 g/l Aluminum Fast Red®
Coloring bath temperature: 60° C.
Coloring time: 10 min.
Immersion rinsing: 2 min. in flowing water of 20° C.

(c) Pointillizing

On anodized aluminum parts or anodized parts fitted with aluminum foil having non-compacted uncolored or colored eloxal films, a pattern is produced by screen printing, preferably with regularly distributed dot, line, bar or circle rasters, cf. FIG. 1A, 1B, 2A, 2B. With respect to the dye volume to be printed out therewith per raster unit, such rasters and arrangements are usable to special advantage for boundary layer flow chemigraphy in flow tunnels where a main flow direction is given and relatively high flow velocities (bar structure) are to be expected. The dye supply to be dissolved per raster unit is greater for line and bar structures than for dot rasters. A further possibility of increasing the local dye volume or dye deposit and of being free from preferential directions is opened up by printing screens with circle raster arrangements as shown in FIG. 3A and 3B. There also may be used rasters of triangles (with the point in main flow direction), elongated rhombi or squares and the like in advantageous arrangement for printing on surface-active eloxal film surfaces.

The printing screens provided with the appropriate hole structure are now tightly clamped in the screen printing frame at a distance of 1–3 mm above the eloxal film surface of the Al foil or Al sheet and the dye pastes or reagent pastes are applied. The screen printing of the dye pastes is performed with a rubber doctor blade on the uncompacted dry eloxal film surface.

The raster units of dye or reagent pastes contain per raster structure practically equal quantities of adsorbable dye or chemically active reagents in practically equal spatial form (pointed cone, hemisphere, rampart, etc.), so that over the entire pointillized eloxal film surface the same material and geometric conditions are provided locally everywhere. The same also is true of the storable pointillized chemigraphy materials obtained after the screen printing by careful and uniform drying.

A. Eloxal color film chemigraphy—Positive

EXAMPLE 1

A cylinder is placed perpendicularly on an aluminum foil pretreated accordng to method (a3) in a water-filled flow tunnel, using Chemigraph material: Al foil 0.1 mm with GS eloxal film of about 15 micron per (a3)
Liquid medium: Water at room temperature homogeneously colored at 0.01 g/l with Aluminum Blue 2LW®
Rate of flow: 0.2 m/s
Exposure time: 4.0 min.

Figure 6:
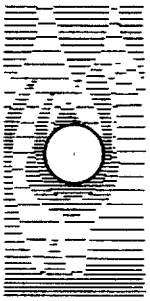
FIGS. 6 and 7 represent boundary layer flow patterns obtained from the methods of Examples 1 and 2, respectively, described hereinafter.

FIG. 6 shows the boundary layer flow pattern in the vicinity of the cylinder. One sees distinctly the shell type formation of the liquid medium building up at the front of the cylinder as resistance body and the "dead water" area caused by eddy formation at the back of the cylinder as the most conspicuous characteristics of the boundary layer flow pattern.

EXAMPLE 2

Figure 7:
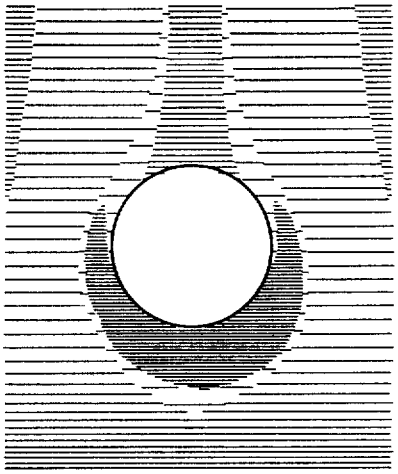

A cylinder coated (a1) with aluminum foil coated per (a3) is placed perpendicularly into the flow tunnel in a medium filled with oil (paraffin) and colored with Aluprint-Marineblue® (5 g/l), dissolved in methyl ethyl ketone. The temperature of the flowing liquid is 70° C., the rate of flow about 8 cm/sec, and the exposure time 8 min. FIG. 7 shows the boundary layer flow pattern in the neighborhood of the cylinder. One sees distinctly that also in oily liquids and at elevated temperatures high-contrast boundary layer flow plots can be obtained. Also in this case the shell formation of the accumulating liquid volume in front of the cylinder as resistance body can be seen. Due to the different viscosity and flow conditions than in water (Example 1), an entirely different boundary layer flow pattern appears on the aluminum foil on the back of the cylinder.

By this procedure flow analyses can advantageously be carried out in auto-and multi-purpose oils.

B. Eloxal color film chemigraph—Negative

EXAMPLE 3

On an aluminum foil, anodized to a thckness of 12 micron with GSX eloxal film according to (a3) and colored red, a cylinder is placed perpendicularly in a water tunnel containing some nitric acid. At a rate flow of 0.5 m/s and an exposure time of 1.5 min a chemigraphic picture of strong contours is obtained for the boundary layer flow pattern. It is very similar to FIG. 6, but in the sense of a color picture negative. Where in FIG. 6 greater color intensities are visible, here the red dye is dissolved out more, and the corresponding surface areas appear silver-bright colorless to pale red.

A similar chemigraphic picture is obtainable when instead of nitric acid highly oxidizing ozone is used. Of this, as little as about 0.01 wt. % is sufficient.

C. Eloxal color film chemigraph—Latent picture with development

EXAMPLE 4

Chemigraphy material: A 140×220 mm Al foil 0.2 mm thick, covered on both sides per (a3) with a GSX eloxal film of about 15 micron, well washed and dried, but not colored.

Test equipment: Hot water nozzle, orifice diameter 1 mm, directed against the prepared Al foil at an angle of about 10°.

Liquid medium: Water of 90° C.

Rate of outflow: >5 m/s

Exposure times:

(a) 0.75 min (at right of Al foil)

(b) 1.5 min (center of Al foil)

(c) 3.0 min (at left of Al foil)

Figure 8A:
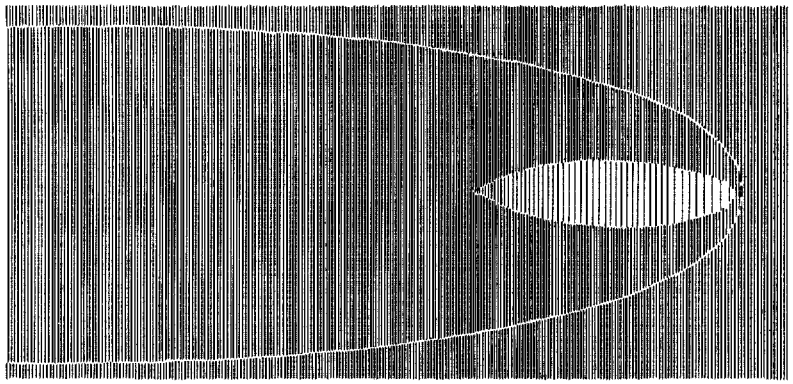
FIGS. 8A, 8B and 8C represent latent chemigraphic pictures obtained from the method of Example 4, described hereinafter.
Figure 8B:
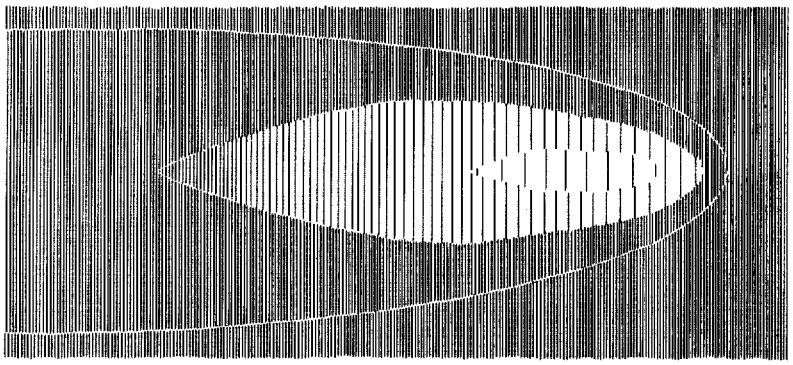
Figure 8C:
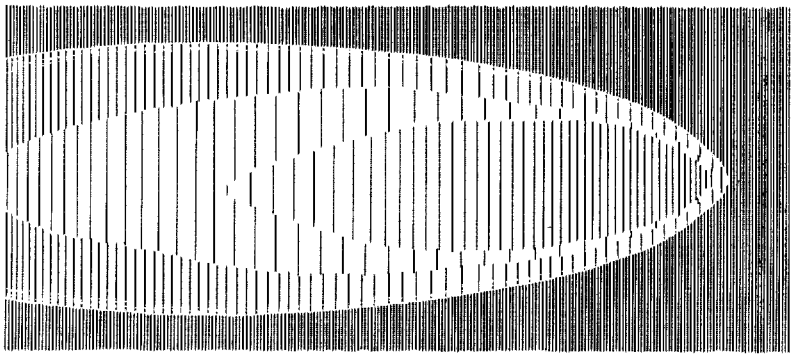

On the colorless surface no boundary layer flow plots can be seen, even though the boundary layer flow has already inscribed itself in the eloxal film by locally different degrees of compaction. By subsequent immersion of the Al foil in a coloring bath 3 g/l Aluminum blue 2 LW® of 20° for 5 minutes, the latent chemigraphic picture becomes visible with strong contrast, as FIG. 8 (A,B,C) distinctly shows. From FIG. 8C the microstructure of the chemigraphic boundary layer flow pattern becomes clearly visible.

This example shows the high sensitivity of the surface-active eloxal film surface to compaction processes with hot water or hydroxyl ions.

EXAMPLE 5

The process set forth in principle in Example 4 is now supplemented in a realistic manner by an experiment in the flow tunnel—in the hot water flow tunnel.

Figure 9:
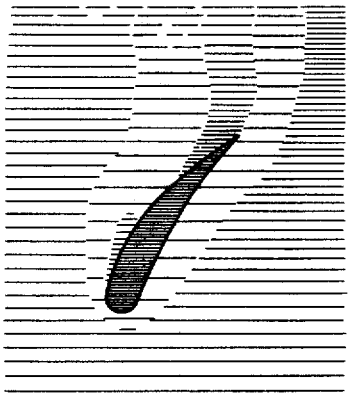
FIG. 9 represents an eloxal color film chemigraph of the boundary layer flow pattern from the method of Example 5, described hereinafter.

FIG. 9 shows the eloxal color film chemigraph of the boundary layer flow pattern around an airfoil section in a flow tunnel operated with hot water.

Dimensions of the airfoil section:

40 mm long 6 mm wide 10 mm high

Chemigraphy material: A sheet 1 mm thick from the Al material. Al material $AlMg_3$ per (a3) covered with a GSX eloxal film of about 12 micron, but not colored.

Liquid medium: Water of 90° C.

Rate of flow: 0.4 m/s

Exposure time: 5.0 min.

The latent chemigraphic picture of the boundary layer flow pattern on the prepared support plate in the immediate vicinity of the resistance body is made visible by immersion in a coloring bath.

Coloring bath: 3 g/l Aluminum blue 2 LW®, 5 min. at 20° C.

The dye can draw in or be adsorbed only in uncompacted or only partially compacted eloxal film microstructures. The local compaction degree is determined by the course and thickness of the hot water boundary layer flow.

D. Pointillization

EXAMPLE 6

Eloxal color pointillization chemigraph of the local boundary layer flow pattern around a cube standing on checker surface (FIG. 10) in the water tunnel.

Dimensions of the cube: 26×26×26 mm;

Chemigraphy material: 0.2 mm thick Al foil of an area of 125×200 mm covered with GSX eloxal film of about 15 micron per (a3) and printed according to D with a dye dot raster consisting of 100 parts by weight Aluprint-Marineblue 2N®

Figure 1B:
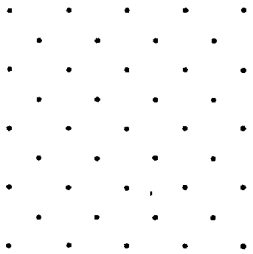

50 parts by weight methyl ethyl ketone 150 parts by weight Aluminium blue 2 LW® according to FIG. 1B.

Dot diameter about 0.5 mm, dot height about 30 micron.

Liquid medium: Water of room temperature.

Rate of flow: 0.4 m/s

Exposure time: 5 min

Figure 10:
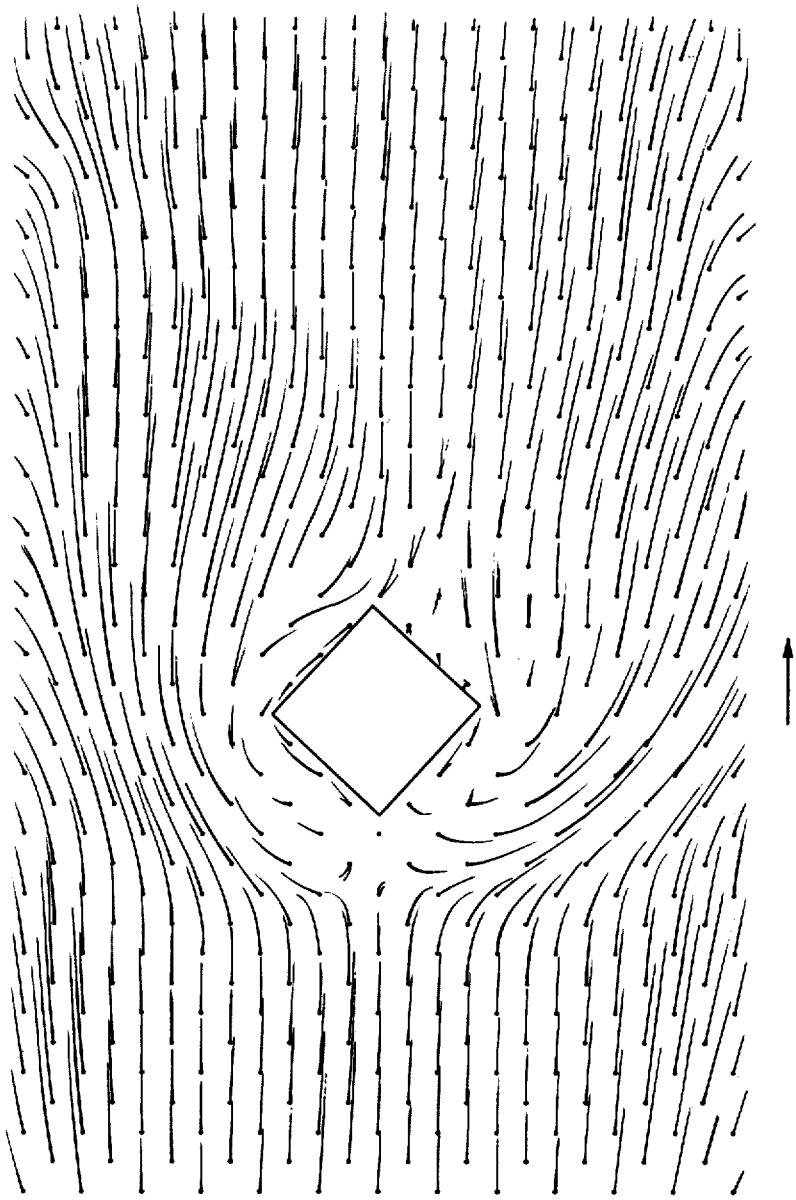
FIGS. 10, 11, 12A and 12B represent eloxal color film pointillization chemigraphs from the methods of Examples 6, 7 and 8, described hereinafter.

As can be seen very well in FIG. 10, the color streamers, which are up to 15 mm long, plot the local course of the boundary layer flow exactly and durably. How different the boundary layer flows are as to direction and velocity in the immediate vicinity of the resistance body is directly visualized chemigraphically by means of the color streamers. By subsequent compaction in boiling de-ionized water the chemigraph was stabilized for a practically unlimited time.

EXAMPLE 7

Figure 11:
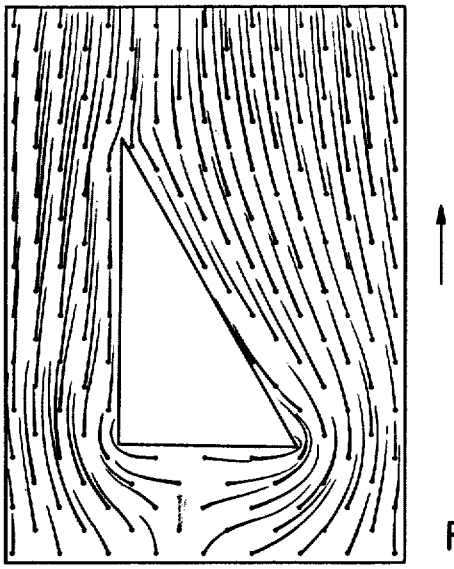

Eloxal color film pointillization chemigraph of the local boundary layer flow pattern around a trilateral prism standing on a triangular surface (FIG. 11) in the oil-filled tunnel.

Dimensions of the prism: 30/50/58 mm base, 30 mm height;

Chemigraph material: Al foil 68×93 mm, 0.1 mm thick, covered with a GSX eloxal film of about 12 micron per (a3) and printed according to (c) with a dye dot raster consisting of 100 parts by weight Aluprint colorless; 50 parts by weight methyl ethyl ketone; 150 parts by weight Sudan blue® in accordance with FIG. 1B. Dot diameter about 0.3 mm, dot height about 20 micron Liquid medium: Paraffin oil at room temperature Rate of flow: 0.5 m/s Exposure time: 5 min With the oil-soluble dye Sudan blue® present in the color paste one obtains, by chemigraphing, color streamers with sharp contours up to 20 mm long, which visualize very distinctly the course of the boundary layer flow around the rectangular prism locally and directionally, inscribing it durably in the eloxal film (see FIG. 11).

EXAMPLE 8

While Examples 6 and 7 prove the excellent possibility of the pointillization technique for the visualization and plotting of the local boundary layer flow direction, the three following examples document the possibility according to the invention of the pointillization technique of making "visible" also the boundary layer flow velocity with consideration of the exposure time, more exactly of correlating the plotted color streamer length with the velocity of the boundary layer flow.

Figure 12A:
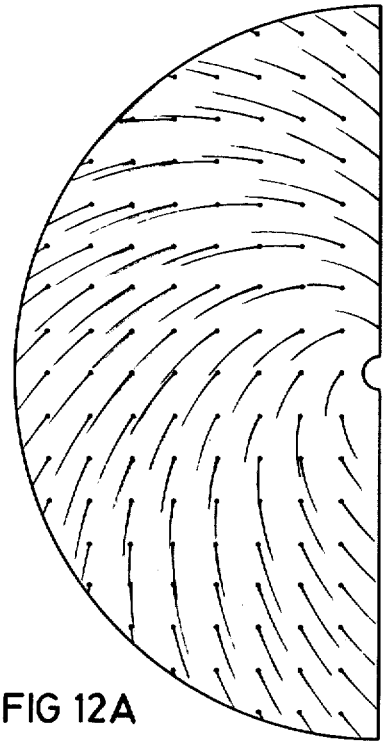
Figure 12B:
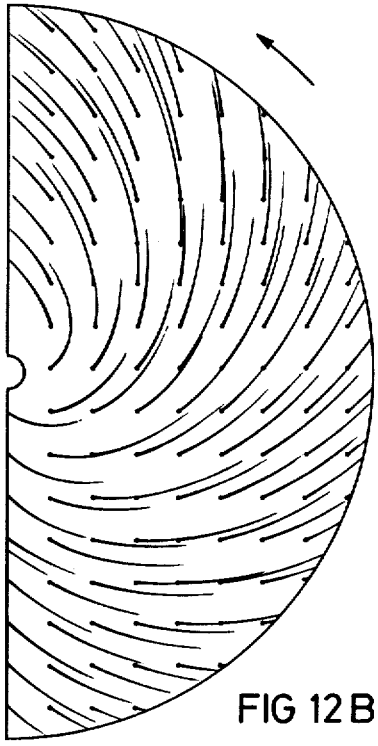

The eloxal color film pointillization chemigraphs in FIGS. 12 and 12B demonstrate in the first place, as an example, the effect of the exposure time on the color streamer length inscribing itself. To be able easily to adjust reproducible test conditions, the surface of a circulating disk of a diameter of 124 mm submerged in the liquid medium was covered with pointillized chemigraphy material and the disk driven through a central axle by means of an adjustable mixing motor.

Figure 5:
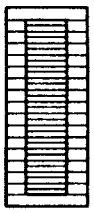

Chemigraphy material: 0.2 mm Al foil covered with GSX eloxal film of about 15 micron per (a3) and printed according to (c) with a dye dot raster in accordance with FIG. 1A and with the color paste according to Example 6. Dot diameter about 0.5 mm, dot height about 30 micron.
Liquid medium: Water at room temperature
Speed of rotation of the disk: 100 rpm
Exposure times:
0.5 min in FIG. 12A
5.0 min in FIG. 12B The chemigraph in FIG. 12A (half of original disk) proves that already in 30 seconds color streamers more than 10 mm long are distinctly inscribed which, as is to be expected from flow and rotation theory, have a greater radius of curvature with increasing distance from the pivot of the disk due to increasing centrifugal velocity of the boundary layer flows, which radius is in direct relation to the local velocity of the boundary layer flow and can be evaluated mathematically.

The chemigraph in FIG. 12B demonstrates that although at a 10 times longer exposure time the color streamers become still clearer and longer (30 mm and more), the radii of curvature remain the same locally because the speed of rotation of the disk has been maintained at 100 rpm.

It is logical to expect that with a sufficiently large dye deposit of equal quantity in the dye dots (the boundary layer flow being necessarily plane under the given conditions) the color streamer lengths will increase with increasing distance from the pivot point due to the increasing velocity of the limit boundary flows and can also be mathematically evaluated for the determination of the local flow velocities. A test series with rotating disks of still greater diameter and dye dot rows arranged crosswise offers for this the experimentally simplest and mathematically clear conditions, as long as the boundary layer flows remain in the laminar range. The findings obtained in such experiments about the relation between color streamer length and velocity of the boundary layer flows are then valid and usable also for laminar boundary layer flows in plane, elongated water tunnels and analogous flow states in equipment and apparatus.

EXAMPLE 9

Figure 2A:
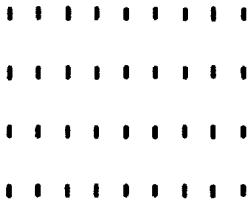
Figure 3A:
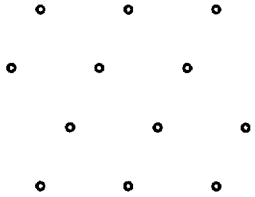
Figure 2B:
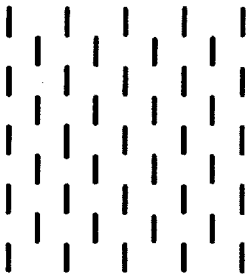
Figure 3B:
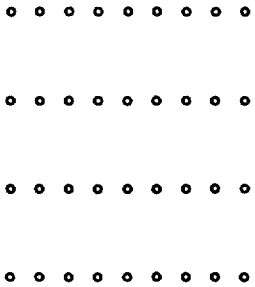
Figure 4:
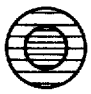
FIGS. 4 and 5 represent schematic illustrations of covering compositions applied over patterns of materials applied to the aluminum layer.
Figures 13, 13A, 13B:
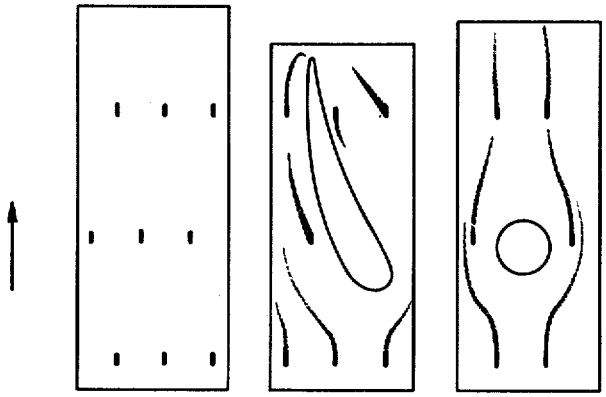
FIG. 13 represents the discontinuous pattern of dye material applied to the aluminum layer of Example 9, described hereinafter.
FIGS. 13A and 13B represent eloxal color film pointillization chemigraphs from the method of Example 9.

For the flow analysis of resistance bodies (sectional shapes, shaped parts, model objects, etc.) in liquid flow tunnels and apparatus with preferably longitudinal flow of a laminar kind, color line and bar structures according to FIG. 2A and 2B instead of dye dots have proved advantageous because of greater quantities of dye deposit. In FIGS. 13, 13A and 13B this form of realization of the pointillization technique is illustrated as an example.

Chemigraphy material: 0.2 mm thick Al foil coated with GSX eloxal film per (a3) about 20 micron thick and then printed according to FIG. 2A or 2B (FIG. 13 shows line structures 0.5 and 1.0 mm wide, respectively, and 2 mm long; height about 30 micron)
Dye paste: per Example 6
Dimensions of the airfoil section: 40 mm long, about 8 mm wide at the head, 15 mm high (FIG. 13A)
Dimensions of the cylinder: 9 mm diameter, 12 mm high; (FIG. 13B)
Liquid medium: Water of 20° C.
Rate of flow: 0.5 m/s
Exposure time: 10 min In both cases strong color streamers have formed, which distinctly visualize and plot the local boundary layer flow with respect to direction and velocity; very informative is the backward boundary layer flow on the concave side of the airfoil section in FIG. 13A. The dye lines contain enough dye for several times longer exposure times. The dark blue color streamers stand out in good contrast from the silver-bright ground of the chemigraphy material.

EXAMPLE 10

Figure 14:
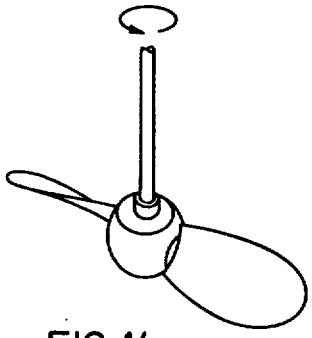
FIGS. 14 and 15 are schematic illustrations of a propeller blade used in the method of Example 10, described hereinafter.
Figure 15:
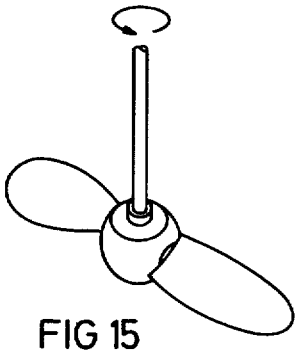

A three-dimensional object for a chemigraphic boundary layer flow analysis which cannot be covered with self-gluing Al foil preparation and does not consist of a brightly anodizing aluminum material, but instead, of a different metal or conductive material, e.g., a propeller blade (FIG. 14 and 15) can be prepared for the process according to the invention by Galvano-Al-Eloxal coating per (a2). The boundary layer flows are visualized and plotted on the propeller blade surfaces of a ship's screw of brass or bronze alloy by means of eloxal color layer pointillization chemigraphy. For this purpose the individual propeller blades are first coated on all sides with Galvano-Al-Eloxal per (a2), the GS eloxal film of about 15 micron being provided with a dye dot raster by pointillizing.

Dimensions of the propeller blades: About 100 mm long, 60 mm wide, 2 mm thick;
Liquid medium: Water of room temperature;
Speed of rotation: about 60 rpm
Angle of attack:
steep, about 60°, FIG. 14
flat, about 20°, FIG. 15
Exposure time: 5 min.

Figure 14A:
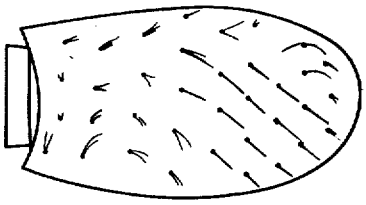
FIGS. 14A, 14B, 15A and 15B represent eloxal color film pointillization chemigraphs from the method of Example 10.
Figure 15A:
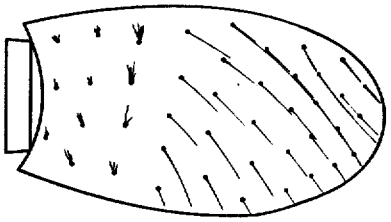
Figure 14B:
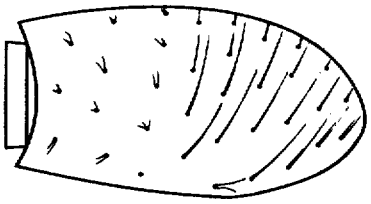
Figure 15B:
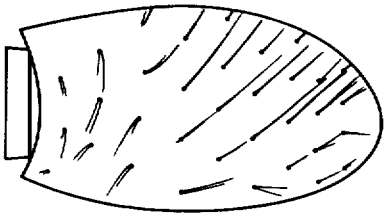

FIGS. 14A and 15A show the top sides and FIGS. 14B and 15B the undersides of the propeller blades with the chemigraphy produced color streamers of the quite different boundary layer flows. Especially on the top sides, the different angles of attack lead to very different boundary layer flows, as the chemigraphs show; however, on the undersides the distinctly differing color streamer directions (steeper in 14B than in 15B) also reflect the influence of the angles of attack. Remarkable are the opposing boundary layer flows near the origin of the propeller blade at the rotary head (especially clear in FIGS. 15A and 15B). For the specialist in fluid mechanics, no doubt the qualitative evaluations of the boundary layer flow chemigraphs obtained with different angles of attack permit an evaluation and optimization of the propeller blade form, but with the exactly determined test parameters, it also is possible to obtain from the directions, radii of curvature and lengths of the color streamers quantitiative results which extend present knowledge about the flow phenomena on and around a ship's screw.

The object of this example, the propeller blade surface, is particularly suitable for double pointillization under difficult analysis conditions, as Example 12 shows.

EXAMPLE 11

Figures 16A, 16B:
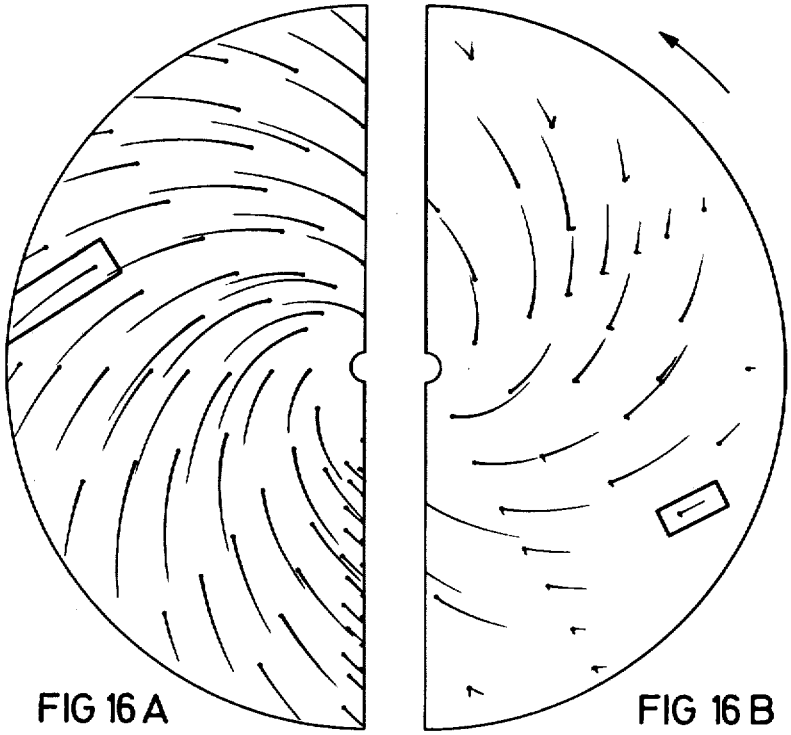
FIGS. 16A and 16B represent eloxal color film pointillization chemigraphs from the method of Example 11, described hereinafter.

This example supplements Example 10 in two perspectives with reference to FIGS. 16A and 16B in eloxal color layer pointillization chemigraphs in non-aqueous liquid media and with respect to the influence of turbulent boundary layer flows on the color streamer lengths.

The test arrangement with a submerged rotating disk of a diameter of 120 mm corresponds in principle to that in Example 10, but the liquid medium is the much more fluid acetone.

Chemigraph material: Al foil 0.2 mm thick, coated with GSX eloxal film about 20 microns thick per (a3), and the cut-out circular disks pointillized with substantially radial dye dot rows. Dot diameter about 0.4 mm, dots about 20 to 30 micron high.

Dye paste:
- 100 parts by weight Aluprint
- Marine Blue 2 N
- 56 parts by wt. methyl ethyl ketone
- 75 parts by wt. Savinyl blue GLS®

Liquid medium:
- Acetone
- Surface tension at 20° C.: $2.37\times10^{-4}$N/cm
- Viscosity at 20° C.: $2.4\times10^{-4}$ Pa.s (by comparison water $7.28\times10^{-4}$ N/cm and $1.01\times10^{-3}$ Pa.s respectively)

Speed of rotation of disk: 100 rpm in FIG. 16A, 500 rpm in FIG. 16B

Exposure time: 2.0 min in both experiments. For the dye dots 50 mm from the pivot point (marked by a rectangle) this corresponds to a velocity of about 0.5 m/s in FIG. 16A or about 3 m/s in FIG. 16B, whereby the first chemigraph (FIG. 16A) has been produced in the range of laminar flow, and the second (FIG. 16B) in the range of turbulent boundary layer flow.

E. Double pointillization

EXAMPLE 12

In accordance with the meaning and purpose of the double pointillization technique—exclusion of immersion and start-up effects—to plot the boundary layer flows in the surrounding of a model Voith-Schneider propeller with 4 blades, the ship's bottom of the model boat is pasted up with double-pointillized chemigraphy material in order to exclude falsification of the chemigraphy as the model boat is being immersed and as the propeller is started up.

Chemigraphy material: Al foil 0.2 mm thick, size 130×210 mm coated with a GSX-eloxal layer about 15 micron thick per a3) and printed with a color dot raster according to FIG. 1A with covering paste raster. Dot diameter 0.4 mm, dot height about 25 micron; covering dot diameter 0.7 mm, height about 60 micron.

Dye paste: per Example 6

Figure 17:
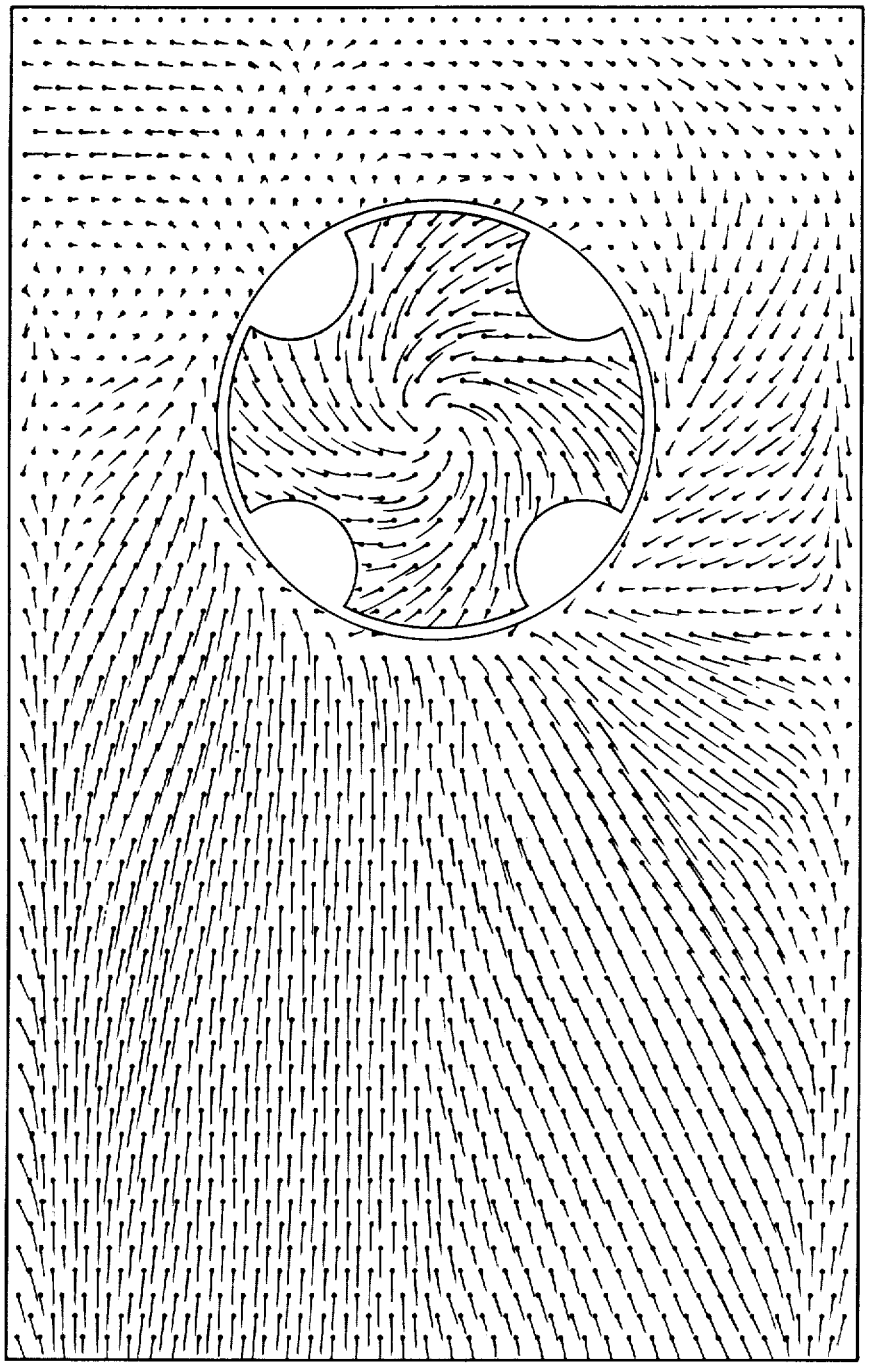
FIG. 17 represents the eloxal color film pointillization chemigraph from the method of Example 12, described hereinafter.

Covering paste:
- consisting of 56 parts by wt. sucrose.
- 4 parts by wt. methyl cellulose
- 46 parts by wt. water Diameter of the propeller rotor: 65 mm Length of the propeller blade: 60 mm Liquid medium: Water of room temperature Speed of rotation of propeller rotor: 500 rpm Immersion and start-up time: about 1 min Exposure time (thereafter): 3 min FIG. 17 shows the eloxal color layer pointillization chemigraph of the boundary layer flows on the ship's bottom and on the rotor surface as produced by a Voith-Schneider propeller. At practically every point of the flow-exposed surface the direction of the respective boundary layer flow can be seen and from it also the direction of rotation of the propeller rotor can be inferred. Especially interesting are areas to the right and above the rotor, where evidently two main flow directions caused by the uniformly revolving propeller rotor have manifested themselves.

What is claimed is:

1. A process for the chemical plotting of boundary layer flows of liquids over a surface, comprising:
- (a) providing said surface with a colorless, uncompacted or partially compacted anodically oxidizied aluminum layer thereon;
- (b) adding to said liquid a visible dye includable and adsorbable in said aluminum layer; and
- (c) exposing said surface to the flow of said liquid such that the dye contained therein is adsorbed in said aluminum layer to a degree characteristic of the flow of liquid thereover.

2. A process for the chemical plotting of boundary layer flows of liquids over a surface, comprising:
- (a) providing said surface with a homogeneously colored, uncompacted or partially compacted anodically oxidized aluminum layer thereon;
- (b) providing said liquid with an agent capable of decoloring or altering the color of the colored aluminum layer when in contact therewith; and
- (c) exposing said surface to the flow of said liquid such that said colored aluminum layer is decolored or altered in color to a degree characteristic of the flow of the liquid thereover.

3. A process for the chemical plotting of boundary layer flows of liquids over a surface, comprising:
- (a) providing said surface with an uncompacted or partially compacted anodically oxidized aluminum layer homogeneously colored with a coloring material;
- (b) exposing said surface to the flow of said liquid whereby said liquid causes compaction of said aluminum layer to a degree characteristic of the flow of liquid thereover, whereby the coloring material of said layer is immobilized in areas where such compaction occurs; and
- (c) treating said surface to remove from said layer coloring material not contained in compacted areas of said layer.

4. A process for the chemical plotting of boundary layer flows of liquids over a surface comprising:

(a) providing said surface with a colorless, uncompacted or partially compacted anodically oxidized aluminum layer;

(b) providing said liquid with a dye includable and adsorbable in uncompacted areas of said aluminum layer; and (c) exposing said surface to the flow of said liquid whereby said liquid causes compaction of said aluminum layer to a degree characteristic of the flow of liquid thereover, and wherein the dye in said liquid becomes included only in uncompacted areas of said aluminum layer.

5. A process for the chemical plotting of boundary layer flows of liquids over a surface, comprising:

(a) providing said surface with an uncompacted or partially compacted anodically oxidizied aluminum layer thereon;

(b) thereafter providing said aluminum layer with a predetermined discontinuous pattern of a material containing a dye dissolvable in said liquid and includable in said aluminum layer; and (c) exposing said surface to the flow of said liquid whereby said material on said aluminum layer is dissolved in said liquid in a proportion characteristic of the flow of said liquid thereover and the dissolved dye then included in said aluminum layer in a manner characteristic of the course of the flowing liquid thereover.

6. The process according to claim 5 wherein said dye-containing material provided on said aluminum layer comprises a dye dissolvable in said liquid and includable in said aluminum layer and a covering composition dissolvable in said liquid, but not includable in said aluminum layer.

7. A process for the chemical plotting of boundary layer flows of liquids over a surface, comprising:

(a) providing said surface with an uncompacted or partially compacted anodically oxidized aluminum layer thereon;

(b) thereafter providing said aluminum layer with a predetermined discontinuous pattern of a material containing a dye dissolvable in said liquid and includable in said aluminum layer;

(c) thereafter providing the patterned material on said aluminum layer with a composition slowly dissolvable in said liquid; and (d) exposing said surface to the flow of said liquid whereby, after first dissolving said composition, said liquid dissolves the dye-containing material on said aluminum layer in a proportion characteristic of the flow of said liquid thereover and the dissolved dye then included in said aluminum layer in a manner characteristic of the course of the flowing liquid thereover.

8. A material for the chemigraphic plotting of boundary layer flows of liquid over a surface comprising a surface-anodized, uncompacted aluminum layer containing a predetermined discontinuous pattern of dye-containing material.

9. A material according to claim 8 further comprising a composition coated over said discontinuous pattern of dye-containing material.

10. A material according to claim 9 wherein said composition consists, by weight, of 2 to 3 parts gelatin, 0.5 parts methyl cellulose and about 60 parts water.

11. A material according to claim 9 wherein said composition consists, by weight, of 50 parts sucrose, 4 parts methyl cellulose and 46 parts water.

* * * * *